United States Patent [19]

Mann et al.

[11] 4,290,263

[45] Sep. 22, 1981

[54] DIESEL ENGINE EXHAUST TRAP PARTICULATE DISTRIBUTION AND INCINERATION BALANCING SYSTEM

[75] Inventors: Gamdur S. Mann; Dilip V. Tendulkar, both of Flint; William J. Parker, Burton, all of Mich.

[73] Assignee: General Motors Corporation, Detroit, Mich.

[21] Appl. No.: 102,966

[22] Filed: Dec. 12, 1979

[51] Int. Cl.[3] ..... F01N 3/02

[52] U.S. Cl. ..... 60/311; 55/419; 55/484; 55/500; 55/DIG. 30

[58] Field of Search ..... 60/311, 296; 55/DIG. 10, DIG. 30, 418, 419, 483, 484, 500, 583

[56] References Cited

U.S. PATENT DOCUMENTS

| | | | |
|---|---|---|---|
| 2,552,847 | 5/1951 | Farr | 55/483 |
| 3,211,534 | 10/1965 | Ridgway | 60/296 |
| 3,937,015 | 2/1976 | Akado | 60/311 |
| 3,954,449 | 5/1976 | Rudorfer | 55/484 |
| 4,167,852 | 9/1979 | Ludecke | 60/296 |
| 4,205,971 | 6/1980 | Abthoff | 55/523 |

FOREIGN PATENT DOCUMENTS

| | | | |
|---|---|---|---|
| 830878 | 2/1952 | Fed. Rep. of Germany | 55/500 |
| 2248359 | 4/1973 | Fed. Rep. of Germany | 55/523 |
| 2411883 | 9/1974 | Fed. Rep. of Germany | 55/484 |
| 2736433 | 2/1979 | Fed. Rep. of Germany | 55/484 |

*Primary Examiner*—Douglas Hart
*Attorney, Agent, or Firm*—Robert J. Outland

[57] ABSTRACT

A diesel particulate trapping and incineration system including a porous wall monolithic ceramic filter element having dual open-ended inlet passages separated from adjacent exhaust passages by particulate filtering porous walls. A balancing system for the distribution and incineration of particulates is provided including dual inlet ducts feeding exhaust gases to both ends of the inlet passages and valve means for controlling the amount of inlet gas flow entering the open opposite ends of the inlet ducts. In this way control is obtained of distribution of particulates over the length of the inlet duct walls as well as of the incineration of particulates upon heating of the exhaust gases to incineration temperature.

3 Claims, 4 Drawing Figures

DIESEL ENGINE EXHAUST TRAP PARTICULATE DISTRIBUTION AND INCINERATION BALANCING SYSTEM

TECHNICAL FIELD

This invention relates to diesel engine exhaust systems having exhaust particulate collection traps. More particularly, the invention relates to arrangements for balancing the distribution incineration of combustible particulates collected in ceramic monolith porous wall filter elements in diesel exhaust systems.

BACKGROUND OF THE INVENTION

United States patent application Ser. No. 99,933, filed Dec. 3, 1979 in the names of Morris Berg, William Johnston and Carl Schaefer and assigned to the assignee of the present invention, discloses various forms of ceramic monolith porous wall filter elements for use as diesel exhaust particulate traps in the exhaust systems of diesel engines particularly those used in automotive vehicles. Tests have indicated such traps to be highly efficient means for trapping and retaining the carbonaceous particulates present in the exhaust gases of diesel engines. However, some difficulty has been encountered in attempting to regenerate or clean such filter elements by incineration of accumulated particulate deposits in situ merely through heating of the filter inlet gases as has been previously proposed.

The difficulty encountered in incineration of particulates in ceramic monolith filter elements appears to be that the temperature distribution of hot exhaust gases supplied to the element varies significantly within the inlet passages during the incineration process. This results in one area becoming clean before the others, thereby short circuiting the exhaust gas through the cleaned area and making it difficult to raise the remaining portion of the collected particulates to the incineration temperature. The problem is compounded by the heat insulating properties of the ceramic filter media which do not promote the conduction of heat from one area of the element to another. It is, thus, desired to provide improved means and methods for accomplishing incineration of particulates in ceramic monolith exhaust particulate traps for diesel engines and the like.

SUMMARY OF THE INVENTION

The present invention provides novel arrangements of ceramic monolith diesel exhaust particulate traps and their accompanying exhaust distribution systems which yield some of the desired advantages. The proposed arrangements contemplate supplying diesel exhaust gases through dual duct means to both ends of dual openended inlet passages of a ceramic monolith filter. Means are also provided to vary the amount of flow passing into the opposite open inlet passage ends so as to control (1) the distribution of particulates collected on the inlet passage walls and, subsequently, (2) the flow of heated exhaust gas and the resultant temperature distribution within the inlet passages during incineration of particulates, thus providing for substantially improved capability for cleaning of the monolithic cermic filter element.

These and other features and advantages will be more fully understood from the following description of certain preferred embodiments taken together with the accompanying drawing.

BEST MODE FOR CARRYING OUT THE INVENTION

Figure 1:
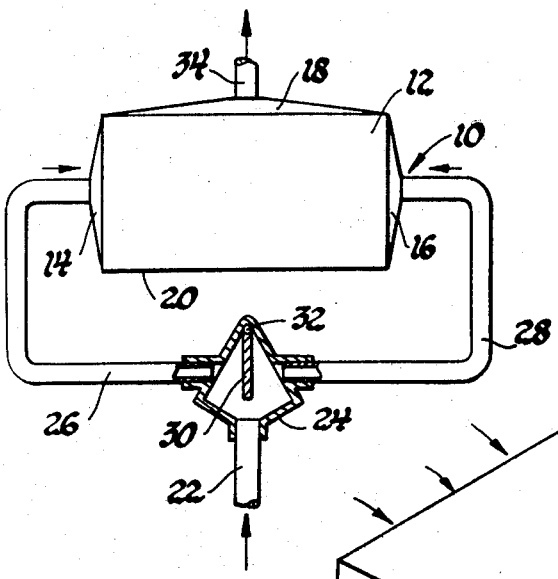
FIG. 1 is a plan view of a diesel exhaust particulate trap and exhaust distribution system formed in accordance with the invention.

Referring first to FIG. 1 of the drawings, there is disclosed a suggested embodiment of diesel exhaust particulate trap and gas distribution system according to the invention and generally indicated by numeral 10. System 10 includes an exhaust particulate trap 12 having exhaust gas inlet headers 14, 16 at opposite ends and a gas outlet header 18 along one side. The side 20 opposite the outlet header and the top and bottom of the trap are closed.

Trap 12 is connected with a distribution system which includes a single inlet pipe 22 which may be the exhaust pipe of a vehicle diesel engine. Pipe 22 leads to a distribution valve 24 that connects with left and right delivery pipes 26, 28. These connect in turn with the trap inlet headers 14 and 16 respectively. A distributing vane 30 within the valve 24 is movable by any suitable means, not shown, around a pivot point 32 to vary the amount of inlet gas flow delivered to the left and right hand delivery pipes 26, 28, including, if desired, cutting off completely the flow to either of the pipes. An exhaust pipe 34 connects with the outlet header 18 to receive cleaned exhaust gases from the particulate trap and discharge them through the vehicle exhaust system, not shown.

Figure 2:
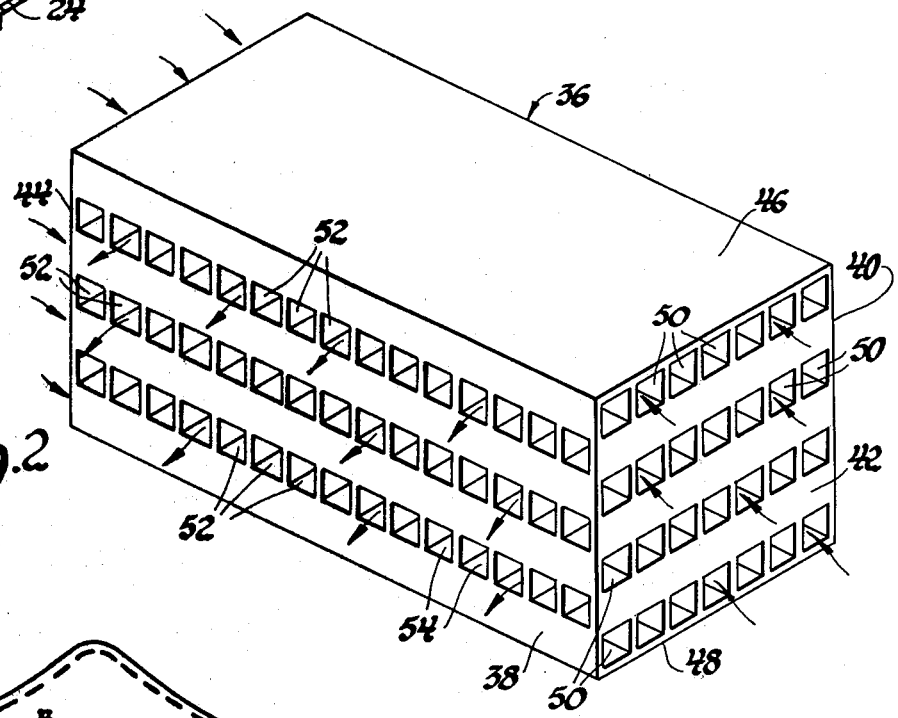
FIG. 2 is a pictorial view of a cross-flow monolithic ceramic filter element for use in the particulate traps of FIGS. 1 and 3.

FIG. 2 of the drawings illustrates a crossflow type ceramic monolithic filter element generally indicated by numeral 36 and of the type utilized in the particulate trap 12 of FIG. 1. Filter element 36 may be formed in any suitable configuration and manner but is preferably of the form of the filter element described in FIG. 4 of the previously mentioned United States patent application Ser. No. 99,933, the disclosure of which is hereby incorporated by reference. In this form, element 36 comprises a porous wall ceramic body having a front wall 38, a rear wall 40, end walls 42 and 44, a top wall 46 and a bottom wall 48.

Within these enclosing walls, the filter element comprises a series of alternate layers of thin porous-walled passages. These passages include alternate layers of inlet passages 50 which extend transversely through the element and are open at both ends through the end walls 42 and 44. Between the layers of inlet passages are layers of outlet passages 52, which extend transversely to the inlet passages from openings in the front wall 38 to the rear of the element, but are closed at their rear ends by the rear wall 40. The open ends of the inlet passages 50 are connected with inlet headers 14, 16 of the particulate trap 12, while the open ends of the outlet passages 52 connected with the outlet header 18.

The inlet and outlet passages 50, 52 are separated by porous internal walls 54 which are permeable to gas flow but have sufficiently small pores to provide collection surfaces for substantial portions of the particulates present in diesel engine exhaust gases. Thus, the ceramic element 36 provides a substantial area of filtering surface between the inlet and outlet passages 50, 52 respectively in the form of the porous internal walls 54. Alternative Embodiment FIG. 13 illustrates a possible alternative embodiment of diesel exhaust particulate trap and distribution system generally indicated by numeral 56 and is of a type which might appropriately be applied as a substitute for the trap arrangement illustrated in FIG. 3 of the previously mentioned United States patent application Ser. No. 99,933. System 56 includes a particulate trap 58 containing a filter element of the type shown in FIG. 2. Trap 58 includes on opposite ends thereof a pair of inlet headers 60, 62 which connect with the opposite open ends of the inlet passages 50 of the filter element. These headers are respectively supplied with exhaust gas through dual inlet pipes 64, 66 respectively.

Trap 58 is also provided with dual outlet headers 68, 70 which connect with the outlet passages 52 on the left and right sides respectively of the internal filter element front wall 38. Headers 68, 70 also connect with opposite sides of a distribution valve 72, having a pivotable internal vane 74 movable to vary the relative flow from the headers to a single exhaust pipe 76 connectable with the vehicle exhaust system.

Operation of Prior Arrangements

In operation of the particulate trap arrangement illustrated in FIGS. 1 and 2 of the previously mentioned U.S. patent application Ser. No. 99,933, exhaust gases are directed into the filter element inlet passages from which they pass through porous walls into adjacent outlet passages and out through their open ends. During this process, particulates in the exhaust gases are in large part collected on the surfaces of the porous walls of the inlet passages to form a thin cake thereon.

To prevent this cake from developing to a point where excessive resistance to exhaust flow through the filter occurs, it is necessary to periodically clean the filter element. This may be accomplished by heating the particulate deposits to their combustion temperature in the presence of sufficient oxygen to burn them off the ceramic wall surfaces. This may be done by removing the filter element and heating it in a furnace. However, it is preferred to accomplish the cleaning operation while the filter element remains installed in situ on the vehicle in the particulate trap.

Figure 4:
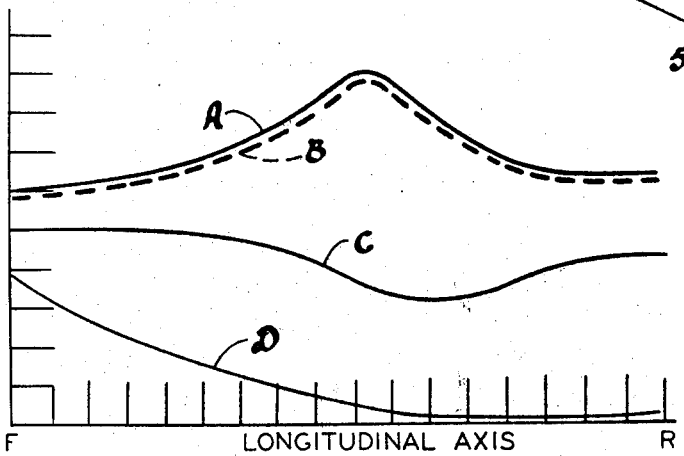
FIG. 4 is a graphical representation of empirically derived conditions apparently present during incineration of particulates in another form of ceramic monolith exhaust particulate filter.

FIG. 4 illustrates graphically an empirically derived typical profile of conditions apparently present during incineration of particulates accomplished by passing heated exhaust gases through a filter element of the type illustrated in patent application Ser. No. 99,933 FIG. 2. The upper line A represents the temperature of the heated particulates in the element, while the second (dashed) line B represents the gas temperature. The third line C indicates the remaining thickness of the particulate cake on the walls of the element and the fourth line D represents the concentration of oxygen in the exhaust gases being passed therethrough. The longitudinal axis of the graph represents the length of the filter from the front inlet end F at the left to the rear outlet end R at the right.

It is seen that the reaction of the hot gases with the collected particulates results in an increasing temperature of the gases and the particulates as the gases move from the inlet to about halfway through the element. After this point, the reduced oxygen level in the gases from combustion of particulates in the front half of the element reduces the combustion reaction, resulting in less of a temperature rise. At the same time, the passage of part of the heated gases through the porous walls into the outlet passages carries the heat past the latter portion of the filter cake without assisting in its combustion.

Accordingly, the filter cake is depleted first near the center of the element at about the point at which the peak combustion temperatures occur during incineration as indicated by line C. Thereafter, a large part of the hot gas passing through the element is short circuited through the cleaned portion of the filter. Thus, it becomes more difficult thereafter to clean the filter cake from those portions of the filter inlet passages at the rear, outlet, end of the filter.

Operation of the FIG. 1 Embodiment

The present invention is arranged to operate in a manner that assists in overcoming this difficulty in incineration as well as to promote more even distribution of the particulate cake during normal operation of the filter. In operation of the arrangement of FIG. 1, exhaust gases enter the system through the inlet pipe 22 and are distributed through the pipes 26, 28 and headers 14, 16 to opposite ends of the filter element inlet passages 50. After entering passages 50, the gases pass through the porous walls 54 into the adjacent outlet passages 52. Thereafter, they flow out through the open ends of the outlet passages into the outlet header 18 and out through the exhaust pipe 34.

The passage of the exhaust gases through the porous walls 54 causes a filtering action which builds a cake of collected particulates on the surfaces of the inlet passage sides of the porous walls as previously described. It is possible that this cake will be relatively evenly distributed if the distribution valve 24 has its distribution vane 30 centered as shown in FIG. 1 so that equal volumes of gas are passed into either end of the filter element. If desired, however, the distribution vane 30 may be moved to any other desired position permanently or may be periodically moved in order to vary the amount of flow entering either end of the filter at different times so as to vary the pattern of gas flow into the inlet passages and thereby more evenly distribute the particulates collected on the passage walls as the gas flows through those walls.

Periodically, the collection of particulates in the inlet passage walls of the filter element will reach a point where it is necessary to clean the collected cake of particulates from the walls in order to regenerate the element for further use before an excessive restriction to exhaust gas flow is created. This may be accomplished in situ by first heating the exhaust gases in any suitable manner, such as, for example, the manner proposed in United States patent application Ser. No. 952,710 now Pat. No. 4,211,075 filed in the names of Otto Ludecke and Theodore Rosebrock and assigned to the assignee of the present invention. The heated exhaust gases are then passed into the system through inlet pipe 22 and the delivery pipes 26 and 28, entering the opposite ends of the filter element inlet passages and heating the particulates therein.

Based upon previous test results and the empirically derived conditions of FIG. 4, it is anticipated that passing all of the heated exhaust gases into one or the other ends of the filter element would yield conditions within the inlet passages essentially like those indicated in FIG. 4. However, when the distribution valve is centered as shown in FIG. 1, it is expected that the resulting flow pattern will yield a pair of peak temperature zones, spaced from one another and located between the center of the element and the extreme inlet ends. Further, it should be possible to move the positions of these peak temperature zones by varying the position of vane 30 in the distribution valve. Thus, it is anticipated that a more complete burn-off of the collected particulates may be accomplished by continuously or periodically varying the position of the vane 30 during the incineration phase so that peak temperatures are reached periodically at various points within the filter element within a range of locations extending over a large portion of the length of the inlet passages. In this way, nearly all of the collected particulates may be burned during the incineration process. If necessary, suitable sensors or other indicating devices could be utilized within the element to determine the condition of the passages and assist in controlling the distribution valve to obtain the desired effect of substantially complete particulate residue incineration.

Figure 3:
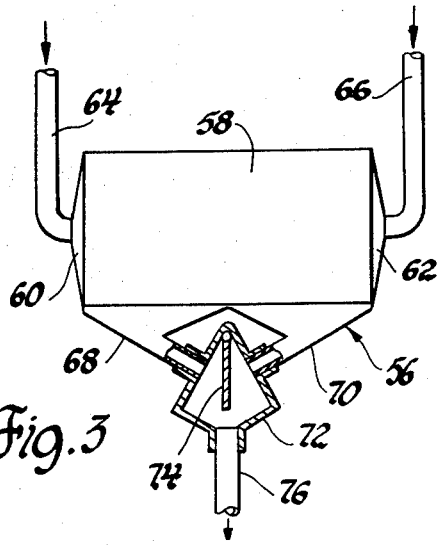
FIG. 3 is a plan view of an alternative embodiment of exhaust particulate trap and distribution system in accordance with the invention.

Operation of the FIG. 3 Embodiment

Turning now to the operation of the embodiment of FIG. 3, the exhaust gases are passed through the two inlet pipes 64, 66 in approximately even amounts into the opposite ends of the filter element within the trap 58. Flow within the inlet passages of the element may be varied, however, by varying the position of the vane 74 in the distribution valve 72, which controls gas flow through the outlet headers 68 and 70. If, for example, vane 74 blocks flow through header 70, all the exhaust gases must pass out through the left hand outlet passages to header 68 and, thus, gases in the inlet passages must pass beyond the middle of the filter element before they can pass through the porous walls into any active outlet passages. If the vane 74 blocks the left hand header 68, the opposite result will ensue. Thus, during normal operation or during incineration, movement of vane 74 in the distribution valve may be used to vary flow within the filter element inlet passages, accomplishing a result similar to that reached by the inlet distribution valve of the first described embodiment.

Variations

While the invention has been disclosed by reference to certain embodiments chosen for purposes of illustration, it should be understood that numerous variations and departures could be made from the disclosed arrangements without departing from the inventive concepts disclosed. Thus, while use of a cross-flow filter element presently appears preferable for the practical use of this concept, it is within the realm of possibility to modify a parallel flow element, such as that of FIG. 2 of application Ser. No. 99,933, so as to provide for entry of exhaust gases to both ends of the inlet passages so as to control the rate of flow at various portions of those passages in the manner proposed herein. Such an arrangement would necessitate a rather complicated header structure which at present is not considered practical, but it is not beyond the realm of possibility. Since these and other changes may be accomplished by those skilled in the art, it is intended that the invention not be limited to the disclosed embodiments, but that it have the full scope permitted by the language of the following claims.

The embodiments of the invention in which an exclusive property or privilege is claimed are defined as follows:

1. A diesel engine exhaust system with particulate collection and incineration balancing means comprising a particulate trap having a plurality of generally parallel inlet passages open at both ends and a plurality of generally parallel outlet passages open at least at one end, said inlet passages extending adjacent said outlet passages and being separated therefrom by porous walls through which exhaust gases may pass from the inlet to the outlet passages and capable of retaining substantial amounts of combustible particulates filtered from the exhaust gases upon such passage, inlet duct means including multiple inlet ducts connected to supply to said inlet passages exhaust gases which may be heated for the incineration of collected particulates, with the opposite ends of each inlet passage being supplied by separate ducts, exhaust duct means including at least one outlet duct connected with the open ends of said outlet passages to receive filtered exhaust gas therefrom, and valve means in at least one of said inlet and exhaust duct means and arranged to differentially vary the flow through the walls separating the various inlet and output passages of the particulate trap, the distribution of particulates to or the burning of particulates on the trap walls being thereby concentrated sequentially at various points whereby a more even distribution of particulates to or a more complete removal of particulates from the trap at all locations may be accomplished.

2. The combination of claim 1 wherein said particulate trap comprises a ceramic monolith filter element.

3. A diesel engine exhaust system with particulate collection and incineration means comprising a particulate trap having a ceramic cross-flow filter element with a plurality of generally parallel inlet passages open at both ends and a plurality of generally parallel outlet passages open at one end, said inlet passages extending adjacent said outlet passages and being separated therefrom by porous ceramic walls through which exhaust gases may pass from the inlet to the outlet passages, said walls being capable of retaining on their surfaces substantial amounts of combustible particulates filtered from the exhaust gases upon such passage, inlet duct means including multiple inlet ducts connected to supply to said inlet passages exhaust gases which may be heated for the incineration of collected particulates, with the opposite ends of each inlet passage being supplied by separate ducts, exhaust duct means including at least one outlet duct connected with the open ends of said outlet passages to receive filtered exhaust gas therefrom, and valve means in said inlet duct means and arranged to differentially vary the flow to the inlet passages of the particulate trap, the distribution of particulates to or the burning of particulates on the trap walls being thereby concentrated sequentially at various points whereby a more even distribution of particulates to or a more complete removal of particulates from the trap at all locations may be accomplished.

* * * * *

UNITED STATES PATENT AND TRADEMARK OFFICE

CERTIFICATE OF CORRECTION

PATENT NO. : 4,290,263

DATED : September 22, 1981

INVENTOR(S) : Gamdur S. Mann, Dilip V. Tendulkar, William J. Parker

It is certified that error appears in the above—identified patent and that said Letters Patent is hereby corrected as shown below:

Col. 1, line 63, "cermic" should read -- ceramic --.

Col. 3, lines 10-11, "Alternative Embodiment" should be written as a heading -- Alternative Embodiment --.

Col. 3, line 12, "Figure 13" should read -- Figure 3 --.

Signed and Sealed this

*Twenty-second* Day of *December 1981*

[SEAL]

*Attest:*

GERALD J. MOSSINGHOFF

*Attesting Officer*

*Commissioner of Patents and Trademarks*